United States Patent [19]

Kronich

[11] Patent Number: 4,995,356

[45] Date of Patent: Feb. 26, 1991

[54] ENGINE FUEL TANK SHROUD HAVING DAMPENED SPRING RETAINERS

[75] Inventor: Peter G. Kronich, Sheboygan, Wis.

[73] Assignee: Tecumseh Products Company, Tecumseh, Mich.

[21] Appl. No.: 532,438

[22] Filed: Jun. 4, 1990

[51] Int. Cl.[5] ..... F02B 77/00

[52] U.S. Cl. ..... 123/198 E; 123/41.7

[58] Field of Search ..... 123/41.7, 198 E, 195 C, 123/2; 440/77; 248/499, 500, 510, 617; 267/73, 74

[56] References Cited

U.S. PATENT DOCUMENTS

| | | | |
|---|---|---|---|
| 1,191,762 | 7/1916 | Conant | 248/503 |
| 1,652,575 | 11/1926 | McGinley | 24/596 |
| 3,091,226 | 5/1963 | Jepson | 123/41.7 |
| 4,367,572 | 1/1983 | Zielenski | 267/74 |
| 4,510,739 | 4/1985 | Dluhosch | 123/195 C |
| 4,573,842 | 3/1986 | Mantela et al. | 267/74 |
| 4,590,890 | 5/1986 | Tamba et al. | 123/41.7 |
| 4,721,070 | 1/1988 | Tanaka et al. | 123/2 |

*Primary Examiner*—Noah P. Kamen

*Attorney, Agent, or Firm*—Jeffers, Hoffman & Niewyk

[57] ABSTRACT

The invention relates to a mounting arrangement for a fuel tank and shroud unit on an internal combustion engine. The plastic shroud unit includes a fuel tank and outer walls extending around the crankcase. The shroud unit is clamped to the crankcase by two springs disposed on opposite sides of the crankcase. In addition, the shroud unit and crankcase have complementary mounting surfaces for supporting the shroud unit on the crankcase.

27 Claims, 2 Drawing Sheets

ENGINE FUEL TANK SHROUD HAVING DAMPENED SPRING RETAINERS

BACKGROUND OF THE INVENTION

The present invention relates to internal combustion engines having a fuel tank and shroud. More specifically, the field of the invention is that of small air cooled internal combustion engines with a combination plastic fuel tank and shroud.

In internal combustion engine requires a fuel tank, which can be made of metal and bolted to the engine. However, a metal fuel tank is often expensive. Also, the engine should be protected by a shroud which can also lessen the amount of noise and vibration transmitted by the engine and serves to channel air over the engine. In many applications including lawn mowers, the fuel tank and shroud are unitary and made of plastic, which is significantly less expensive than metal. However, the attachment of a plastic fuel tank and shroud is difficult and causes additional cost.

One means of attaching a fuel tank and shroud involves mounting them directly on the engine with screws. While direct screw mounting is easy and inexpensive, the plastic eventually fails. The failure may be due to fatigue, or to the screw loosening and falling out due to the normal vibration of the engine and the extrusion of plastic from beneath the screw heads. To securely attach the fuel tank or shroud to the crankcase, additional brackets or fasteners are used to retain the fuel tank and shroud to the engine structure, and additional retainers such as straps are used to mount the plastic components. These additional brackets, fasteners, and retainers add to the complexity and cost of the engine. Further, fuel tanks and shrouds with these attaching devices require a strong grade of plastic to withstand the engine vibration.

What is needed is a fuel tank and shroud which are attached to the engine more simply and economically. Also needed is a fuel tank and shroud which can be fabricated from less expensive materials.

SUMMARY OF THE INVENTION

The present invention is an integral plastic fuel tank and shroud for an internal combustion engine. Springs resiliently clamp together the shroud and crankcase, and the shroud also includes a mounting portion on its lower surface for engaging a mounting portion of the crankcase.

In a preferred form of the invention, the springs extend between the crankcase or its mounting base and the shroud. The crankcase includes tabs which extend to engage the springs, or alternately the base upon which the crankcase is mounted may include tabs. The shroud includes openings having clips extending underneath to engage the springs. The clips include a T-shaped wire having a looped portion for engaging the spring and a flange portion for engaging the slot. The two springs are located on opposite sides of the crankcase for reliably clamping the shroud over the engine.

The mounting portion of the fuel tank shroud includes three, preferably spherical concave mounting surfaces which engage three corresponding, preferably spherical convex mounting surfaces of the crankcase, with the corresponding pairs of mounting surfaces being disposed in a triangular pattern. The crankcase includes cast and cover portions, and the mounting surfaces are preferably stamped on the cover portion.

Thus, the mounting surfaces provide a stable three point support for the shroud and are inexpensively produced by stamping the cover portion.

The present invention provides a resilient dampened mounting system for a fuel tank shroud on a vibrating engine. The fuel tank shroud has fewer parts than prior art structures, thus being more economical. The fuel shroud is attached by springs so that the fatigue and extrusion problems of plastic around screws is avoided. The dampened mounting system also lessens the amount of vibration and stress transmitted to the shroud, so that less rigid plastic can be employed than previously.

The present invention is, in one form, an internal combustion engine comprising a crankcase, a fuel tank and shroud unit, and a spring. The crankcase includes a mounting portion. The shroud unit is disposed over the crankcase, and includes a mounting portion. The mounting portion of the shroud unit engages the mounting portion of the crankcase. The spring provides means for resiliently clamping the shroud unit to the crankcase.

One object of the present invention is to provide a fuel tank and shroud unit which is attached to the engine more simply and economically.

Another object of the present invention is to provide a fuel tank and shroud unit which can be fabricated from less expensive materials.

A further object of the present invention is to provide an integral fuel tank and shroud combination.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
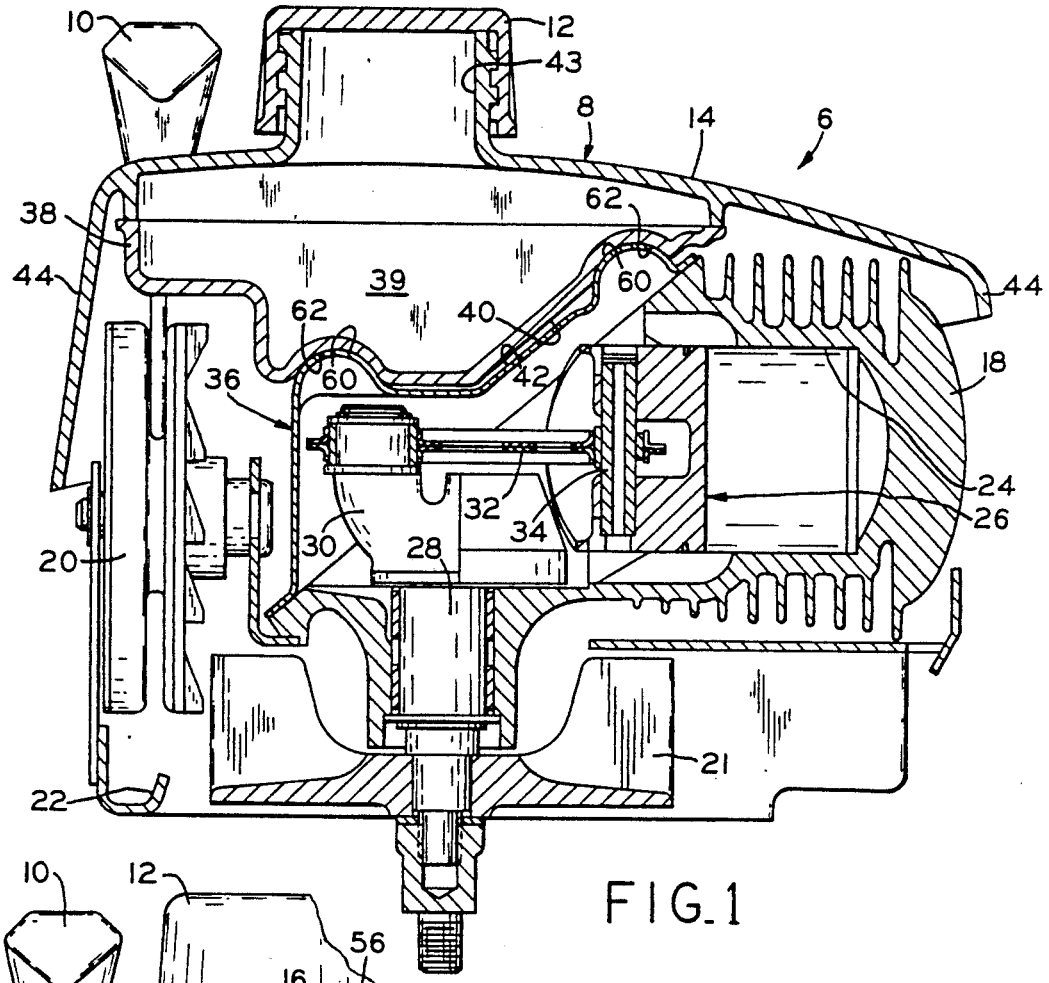
FIG. 1 is a side elevational view, in cross-section, of an internal combustion engine having an integral fuel tank and shroud of the present invention.

The present invention relates to air cooled internal combustion engines such as engine 6. Integral fuel tank and shroud 8 covers the top and much of the sides of engine 6. Pull-start handle 10 and fuel cap 12 extend from top surface 14 of shroud 8. Top surface 14 also includes elongated clip retaining slots 16, described in conjunction with FIG. 2 below. Crankcase 18, starter pulley 20, and flywheel/blower 21 are also located under shroud 8. One example of an application for engine 6 is for a lawn mower, wherein engine 6 is mounted on base 22, which is in turn mounted to the deck of a lawn mower chassis (not shown).

Referring to FIG. 1, crankcase 18 includes cylinder 24 which receives piston 26. Crankshaft 28 includes a counterweight 30 having a connecting rod 32 engaging a wrist pin 34 of piston 26. Crankshaft 28 and piston 26 are enclosed by crankcase engine cover 36 which encloses the interior of crankcase 18. Fuel tank portion 38 of shroud 8 defines fuel reservoir 39, and has a bottom surface 40 supported on upper surface 42 of cover 36. Filler neck 43 of fuel tank portion 38 provides a passage for fuel to enter the fuel reservoir 39, with fuel cap 12 threadedly attached to the exterior of neck 43. Outer wall 44 of shroud 8 extends over crankcase 18 and flywheel 21 for protection and noise reduction.

Figure 2:
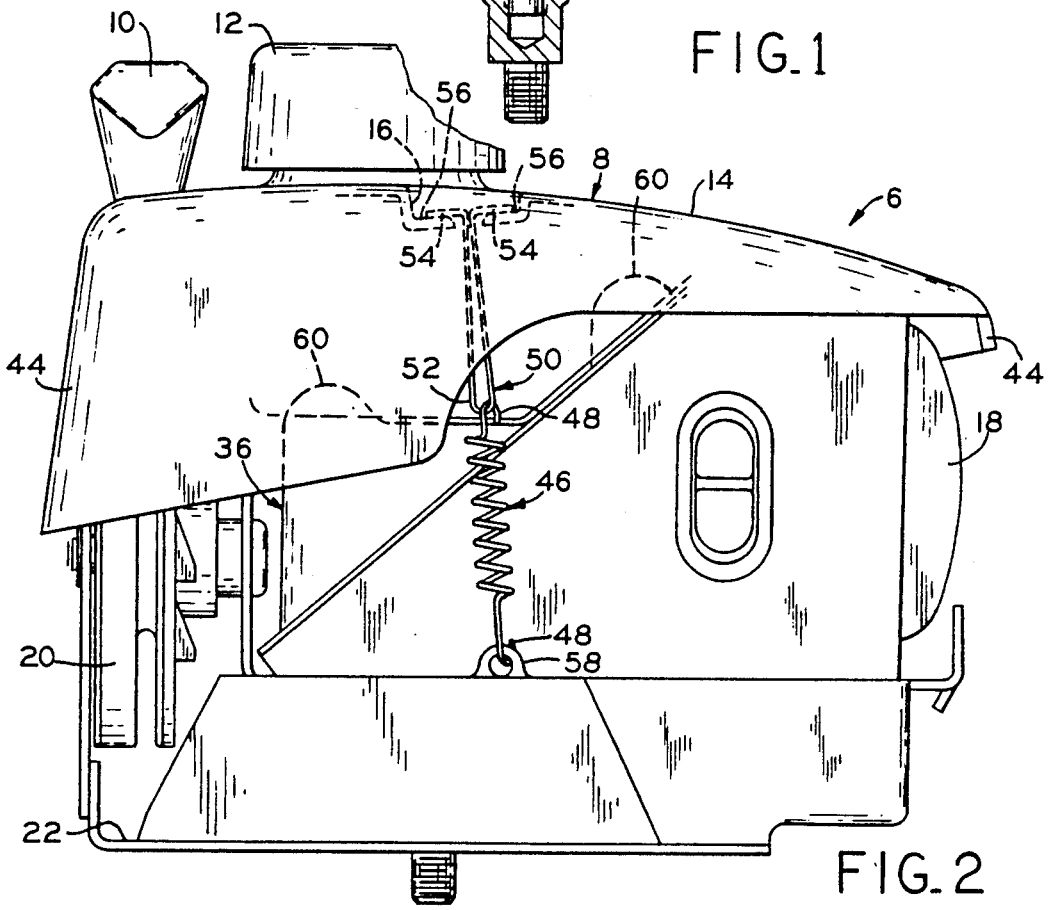
FIG. 2 is a side elevational view of FIG. 1 showing the dampened spring retainers of the present invention.
Figure 3:
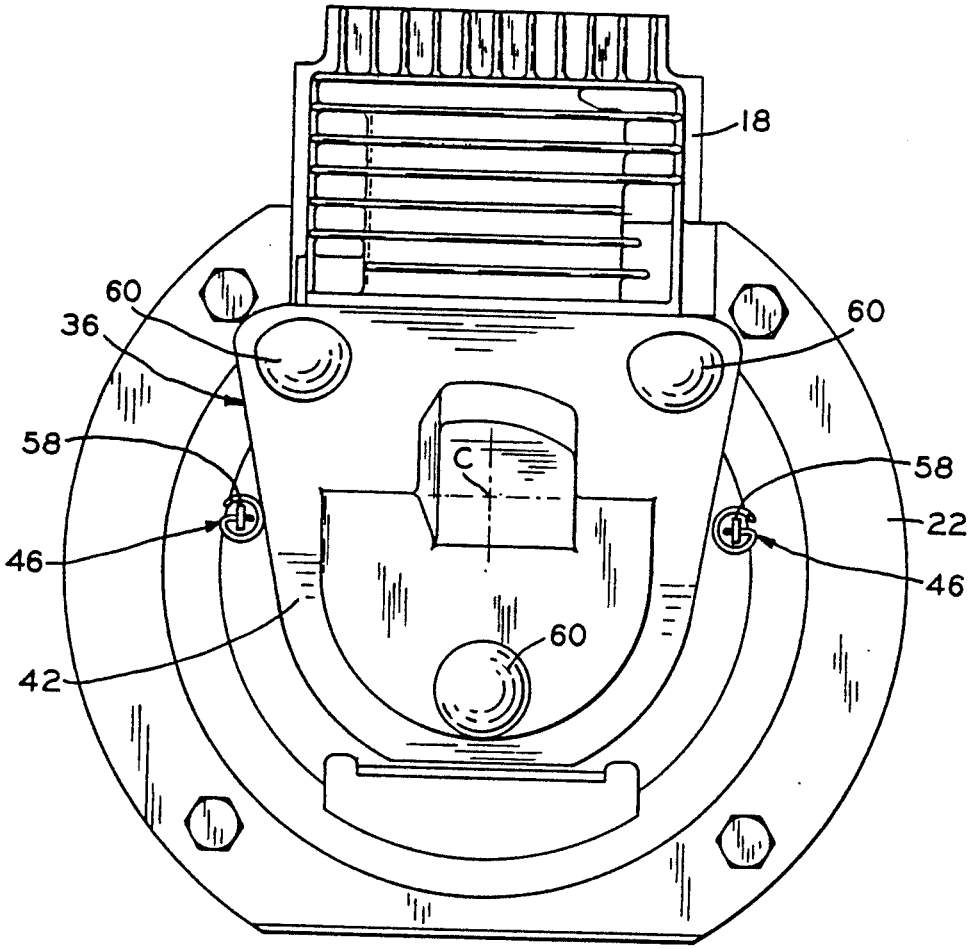
FIG. 3 is a top plan view of the crankcase and crankcase cover of the present invention.
Figure 4:
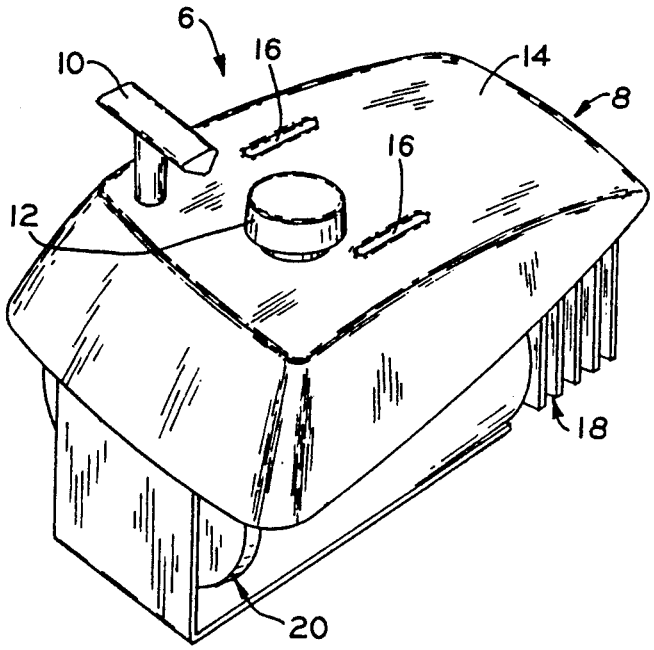
FIG. 4 is a perspective view of the fuel tank and shroud unit over the crankcase of the present invention.

In accordance with the present invention, shroud 8 is clamped to crankcase 18 by springs 46 (see FIG. 2). One hooked end 48 of spring 46 engages hair pin retention clip 50, which engages slot 16 of shroud 8. Clip 50 includes a looped portion 52 for linking with hooked end 48; looped portion 52 extends downwardly from slot 16. Clip 50 also includes flange portions 54 which are located in elongated slot 16, engaging seat 56 of slot 16. The other hooked end 48 engages retention tab 58 of crankcase 18. Preferably, retention tabs 58 are formed on base 22 (FIG. 3) of crankcase 18. A resilient connector such as a cable or cord, a combination of springs and resilient connectors, or other functional equivalents may be substituted for spring 46. Two such springs 46 are provided on opposite sides of crankcase 18 (FIG. 3). The spring force and material frequency of the springs result in the dampened resilient mounting forces.

In accordance with the present invention, surfaces 40 and 42 have complementary mounting portions. In the preferred embodiment, upper surface 42 includes three spherical convex mounted pad surfaces 60 arranged generally equidistantly around the center of rotation C of engine 6 (FIG. 3). Cover 36 is preferably fabricated from sheet metal, with pads 60 formed during stamping of cover 36. Bottom surface 40 includes three complementary spherical socket concave mounting surfaces 62 molded in shroud 8, which interlock and nest on pads 60 to provide a three point suspension for shroud 8. If desired, crankcase 18 could be of one-piece construction rather than comprising a stamped cover 36 as shown.

The present invention provides a resilient dampened mounting system on engine 6 which lessens the effect of engine vibration. Further, the design which includes integral fuel tank and shroud 8, pads 60, and spring 46 is economical because of the relatively small number of components. Shroud 8 floats on a stable three point suspension system (including pads 60 and sockets 62) and has a resilient retention means (including spring 46), thereby reducing direct transmission of vibration to the plastic components making shroud 8 less prone to vibration and fatigue failure. Consequently, a less rigid plastic molding can be used which lowers the cost of providing a fuel tank and shroud compared to the prior art. Preferably, the plastic of shroud 8 is made of high density polyethylene, or polypropylene. The clips and springs are made of #302 stainless steel wire with a spring tension of 6 to 10 pound force.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine comprising:
a crankcase including a first mounting portion;
a fuel tank and shroud unit disposed over said crankcase, said shroud unit including a second mounting portion engaging said first mounting portion which results in a nonrigid attachment that minimizes unit fatigue or detachment caused by vibrations; and
spring means for resiliently clamping said shroud unit to said crankcase.

2. The internal combustion engine of claim 1 wherein said second mounting portion comprises three spherical convex mounting pad surfaces.

3. The internal combustion engine of claim 2 wherein said first mounting portion comprises three spherical concave mounting surfaces interlocked with said mounting pads.

4. The internal combustion engine of claim 3 wherein said first mounting portion and said second mounting portion are substantially equidistantly disposed about the center of rotation of said engine.

5. The internal combustion engine of claim 1 wherein said spring means includes at least two resilient springs clamping said shroud unit to said crankcase.

6. The internal combustion engine of claim 5 wherein said crankcase includes at least two extended tabs, each said spring engaging a corresponding one of said extended tabs.

7. The internal combustion engine of claim 5 wherein said shroud unit includes at least two openings, and said connecting means further includes at least two clips, each of said clips engaged with a respective one of said openings and extending under said shroud unit to engage a respective one of said springs.

8. The internal combustion engine of claim 7 wherein each said clip includes a T-shaped wire having a looped portion for engaging said respective spring, said wire also including a flange portion engaging said respective opening.

9. The internal combustion engine of claim 1 wherein said crankcase includes a cast portion and a cover portion, said first mounting portion being formed in said cover portion.

10. The internal combustion engine of claim 1 wherein said crankcase includes a base portion, and said spring means includes two springs clamping said shroud unit to said crankcase base portion.

11. The internal combustion engine of claim 5 wherein said two springs are disposed on opposite sides of said crankcase.

12. The internal combustion engine of claim 1 further comprising a base upon which said crankcase is supported, said base including at least one extended tab, said spring means engaging said extended tab.

13. In an internal combustion engine including a crankcase, an integral fuel tank and shroud comprising:
a fuel tank portion for storing liquid fuel;
a mounting portion having a bottom surface adapted to engage the crankcase which results in a nonrigid attachment that minimizes unit fatigue or detachment caused by vibrations;
an outer wall portion extending outwardly and downwardly from said mounting portion; and
spring means for resiliently clamping said shroud to the crankcase.

14. The engine of claim 13 wherein said shroud comprises molded plastic material.

15. The engine of claim 13 wherein said mounting portion comprises three mounting surfaces interlocked with three mounting surfaces on said crankcase.

16. The engine of claim 15 wherein said three mounting surfaces on each of said shroud and said crankcase are substantially equidistantly disposed in a triangular pattern.

17. The engine of claim 13 wherein said spring means includes a resilient extension spring.

18. The engine of claim 17 wherein said outer wall portion includes at least one slot, and said spring means further includes at least one clip, said clip engaged with said slot and extending under said shroud to engage said spring.

19. The engine of claim 18 wherein said clip includes a generally T-shaped wire having a looped portion for engaging said spring, said wire also including a flange portion engaging said slot.

20. The engine of claim 18 wherein said spring means includes two springs and two clips clamping said shroud to said crankcase.

21. The engine of claim 20 wherein said two springs are disposed on opposite sides of said crankcase.

22. An air cooled engine and gas tank/shroud assembly comprising:

an internal combustion engine including a crankcase having a crankshaft and piston assembly therein;

a unitary fuel tank and shroud unit disposed over said engine, said shroud unit including a fuel reservoir and side walls extending over at least a portion of said engine crankcase which results in a nonrigid attachment that minimizes unit fatigue or detachment caused by vibrations; and spring means for resiliently clamping said shroud unit to said engine.

23. The assembly of claim 22 wherein said shroud unit is supported on an upper portion of said engine and said engine has a base portion, and said spring means comprises a plurality of springs connected to said shroud unit and to said base portion.

24. The assembly of claim 23 wherein said engine comprises three upwardly facing spaced apart mounting surfaces and said shroud unit comprises three downwardly facing mounting surfaces interlocked with said three upwardly facing surfaces.

25. The assembly of claim 24 wherein there are only three upwardly facing and only three downwardly facing said mounting surfaces that thereby provide a stable three point support for said shroud unit.

26. The assembly of claim 25 wherein said spring means comprises at least two tensioned extension springs disposed on opposite sides of said crankcase and extending between said shroud unit and said engine.

27. The assembly of claim 24 wherein said spring means comprises at least two tensioned extension springs disposed on opposite sides of said crankcase and extending between said shroud unit and said engine.

* * * * *